US005336373A

United States Patent [19]

Scattolino et al.

[11] Patent Number: 5,336,373

[45] Date of Patent: Aug. 9, 1994

[54] METHOD FOR MAKING A STRONG, BULKY, ABSORBENT PAPER SHEET USING RESTRAINED CAN DRYING

[75] Inventors: Thomas F. Scattolino, Milmont Park, Pa.; Howard J. Stern, Vineland, N.J.; John G. Trumball, Lima, Pa.; Richard I. Wolkowicz, Turnersville, N.J.

[73] Assignee: Scott Paper Company, Philadelphia, Pa.

[21] Appl. No.: 997,829

[22] Filed: Dec. 29, 1992

[51] Int. Cl.[5] ..... D21F 11/02

[52] U.S. Cl. ..... 162/116; 162/109; 162/205; 162/206

[58] Field of Search ..... 162/109, 116, 204, 205, 162/206, 188, 114, 113

[56] References Cited

U.S. PATENT DOCUMENTS

| | | | |
|---|---|---|---|
| 1,701,226 | 12/1927 | Collins | 162/290 |
| 2,091,805 | 8/1937 | Chuse | 92/38 |
| 2,683,088 | 7/1954 | Reynolds, Jr. | 92/3 |
| 2,778,749 | 1/1957 | Bainbridge, Jr. et al. | 117/154 |
| 3,301,746 | 1/1967 | Sanford et al. | 162/113 |
| 3,303,576 | 2/1967 | Sisson | 34/115 |
| 3,447,247 | 6/1969 | Daane | 34/122 |
| 3,503,139 | 3/1970 | Mahoney | 34/111 |
| 3,560,333 | 2/1971 | Douglas et al. | 162/206 |
| 3,576,078 | 2/1971 | Holt | 34/23 |
| 3,629,056 | 4/1972 | Forrest | 34/70 |
| 3,874,997 | 4/1975 | Kankaanpaa | 162/290 |
| 3,891,500 | 6/1975 | Kankaanpaa | 162/348 |
| 4,072,557 | 2/1978 | Schiel | 162/111 |
| 4,102,737 | 7/1978 | Morton | 162/113 |
| 4,172,007 | 10/1979 | Kankaanpaa | 162/206 |
| 4,196,045 | 4/1980 | Ogden | 162/117 |
| 4,302,282 | 11/1981 | Young | 162/111 |
| 4,308,092 | 12/1981 | Latimer et al. | 162/111 |
| 4,309,246 | 1/1982 | Hulit et al. | 162/113 |
| 4,351,699 | 9/1982 | Osborn, III | 162/112 |
| 4,440,597 | 4/1984 | Wells et al. | 162/111 |
| 4,441,962 | 4/1984 | Osborn, III | 162/111 |
| 4,447,294 | 5/1984 | Osborn, III | 162/111 |
| 4,529,480 | 7/1985 | Trokhan | 162/109 |
| 4,632,730 | 12/1986 | Ulubay et al. | 162/111 |
| 4,940,513 | 7/1990 | Spendel | 162/112 |
| 4,959,125 | 9/1990 | Spendel | 162/158 |
| 4,986,882 | 1/1991 | Mackey et al. | 162/146 |
| 5,048,589 | 9/1991 | Cook et al. | 162/109 |

OTHER PUBLICATIONS

*Das Papier*, "The Influence of the Tensile Forces During the Drying of Paper on the Behavior of Paper" Author: Walter Brecht and Dieter Pothmann.

*TAPPI Journal*, "Practical Effects of Sheet Stratification Caused by Wet Pressing"; M. A. MacGregor; Jul. 1983.

*1990 Engineering Conference*—TAPPI Proceedings, "No Draw Drying"; Author Sam Palazzolo.

*1988 Engineering Conference*—TAPPI Proceedings, "No-Drying Restraint"; Author: Gregory L. Wedel.

*TAPPI Journal*, "The Drying of Paper"; Author: Arthur C. Dreshfield, Jr. and S. T. Han; Jul. 1956.

*Chemical Engineering Progress*, "Hot-Surface Drying of Fibrous Sheets"; Author: A. C. Dreshfield, Jr.; Apr. 1957.

*SPCI*, "Commercial Experience with Restraint Drying"; Author: Jeffrey H. Pulkowski and Giorgio Baldini.

*Primary Examiner*—W. Gary Jones
*Assistant Examiner*—Dean T. Nguyen
*Attorney, Agent, or Firm*—Mark G. Bocchetti; John W. Kane, Jr.

[57] ABSTRACT

A process for making a strong, bulky, absorbent paper sheet with improved uniformity by forming the web on a forming fabric with a furnish having a consistency in the range of from about 0.08% to about 0.6% solids, dewatering the web noncompressibly such that the web is the range of from about 30% to about 40% dry, transferring the web from the forming fabric to an imprinting fabric, lightly pressing the web and the imprinting fabric against the drying can to form a pattern of densifications in the web, can drying the web from no more than about 30% to 40% dry to at least 55% to 60% dry, and restraining the web between the imprinting fabric and the drying can during the can drying step until the web is at least 55% to 60% dry. In addition to the benefits on uniformity, chemicals added to the furnish such as wet strength resins, dry strength resins, surfactants and dyes will migrate during the drying step to the face of the sheet facing the drying can and, specifically, to the densifications formed in the sheet.

24 Claims, 4 Drawing Sheets

MD TENSILES.

B.W. SAMPLE.
2.45" X 2.45"
8 - PLY

CD TENSILES

METHOD FOR MAKING A STRONG, BULKY, ABSORBENT PAPER SHEET USING RESTRAINED CAN DRYING

BACKGROUND OF THE INVENTION

1. Field of the Invention.

The present invention relates generally to non-creped webs for towel and tissue and, more particularly to methods for making non-creped webs with improved uniformity in the base sheet.

2. Brief Description of the Prior Art,

U.S. Pat. No. 3,301,746 to Sanford, et al. teaches a process for forming absorbent paper by imprinting a fabric knuckle pattern thereon. Sanford, et. al. teaches a process whereby the papermaking furnish is delivered to a forming wire. The uncompacted paper web is vacuum dewatered and transferred to the imprinting fabric. The imprinting fabric carries the web through a hot air dryer to thermally pre-dry the web from about 30% to 80% dry. The pre-dried web still supported on the imprinting fabric is pressed against and transferred to the surface of the Yankee dryer. The web is then creped from the Yankee dryer surface. An alternative embodiment is also taught by Sanford et. al. wherein the papermaking furnish is distributed directly on an imprinting fabric. The web is once again vacuum dewatered, thermally predried, and then pressed against and transferred to the surface of the Yankee dryer, while supported on the imprinting fabric. The web is then pulled from the surface of the Yankee Dryer.

U.S. Pat. No. 4,102,737 to Morton teaches a twin wire forming operation wherein the foraminous drying-/imprinting fabric used to thermally pre-dry a moist web is extended to the twin wire formation zone. As in Sanford, the web is ultimately transferred to the surface of the Yankee drum being pressed thereon using the imprinting fabric and the web is then creped from the drum. Prior to the transfer of the web to the surface of the Yankee dryer, the web is thermally pre-dried to a fiber consistency of at least about 30%, and most preferably, to a fiber consistency between about 30% and about 98%.

U.S. Pat. No. 4,440,597 to Wells, et. al. teaches a method for shortening a wet laid embryonic web through the use of a differential velocity transfer from the carrier fabric to a transfer or imprinting fabric (negative draw). The web is ultimately transferred to a Yankee and creped therefrom. Prior to transfer to the Yankee dryer surface, the web is pre-dried.

U.S. Pat. No. 5,048,589 to Cook, et al. teaches a non creped and/or wiper towel is made by forming a furnish which includes a chemical debonder, depositing that furnish on a forming wire, moving the web on the forming wire to a through dryer to non-compressibly dry the web, and then removing the dried web from the foraminous wire without creping. Cook et. al. further suggests that the transfer from the forming wire to the through dryer can be made with a negative draw. By negative draw, it is meant that the forming wire is travelling faster than the through drier belt.

SUMMARY OF THE INVENTION.

It is an object of the present invention to provide a process for making a low density paper base web for towels and tissues without creping.

It is a further object of the present invention to provide a process for making low density paper based web with significantly improved uniformity in terms of strength, bulk, thickness and absorptive capacity.

Still a further object of the present invention is to provide a process for making a low density paper base web wherein water removal is not accomplished through overall pressing of the web.

Yet another object of the present invention is to provide a process for making a low density paper base web for towels and tissues with a lower machine direction variation in strength and basis weight.

It is a feature of the present invention to provide a process for making a low density paper base web having a pattern of densifications therein wherein fines are concentrated in the densifications.

Another feature of the present invention is to provide a process for drying a low density paper base web for towels and tissues having a pattern of densifications therein wherein chemicals added to the furnish are caused to migrate and thereby concentrate on one surface of the finished sheet and particularly, on one surface of the densifications.

A further object of the present invention is to provide a process for making a low density paper base web which does not rely on the use of chemical debonders.

Briefly stated, these and numerous other features, objects and advantages of the present invention will become readily apparent upon a reading of the detailed description, claims and drawings set forth herein. These objects, features and advantages for making a strong, bulky, absorbent paper sheet having a basis weight between from about 7 to about 70 pounds per ream are accomplished by first forming a web on a forming fabric with a furnish having a consistency preferably in the range from about 0.10% to about 0.20% solids, dewatering the web noncompressively such that the web is in the range of from about 8% to about 40% dry, and then transferring the web from the forming fabric to a knuckled, imprinting or carrier fabric by means of a vacuum pickup. The web is then lightly pressed while supported on the imprinting fabric against one or more can dryers to thereby form a pattern of densifications in the web. Can drying of the web is then accomplished from no more than about 40% dry to at least about 60% dry while the web is being restrained between the imprinting fabric and the drying can(s). The term "restrained can drying" is used herein to mean that while the web is being can dried, it is held between the carrier fabric and the surface of the can dryer. It may further be necessary to apply a release to the drying can so that the sheet is not pulled from the imprinting fabric as the web traverses the drying can(s). In addition, it is advantageous to perform the transferring step of the process of the present invention with the forming fabric travelling faster than the imprinting fabric to thereby make such transfer with a negative draw. The terms "can drying" and "drying cans" are used herein to refer to and include Yankee dryers and other rotating, solid surface, heated drums.

DETAILED DESCRIPTION OF THE PREFERRED EMBODIMENT.

Figure 1:
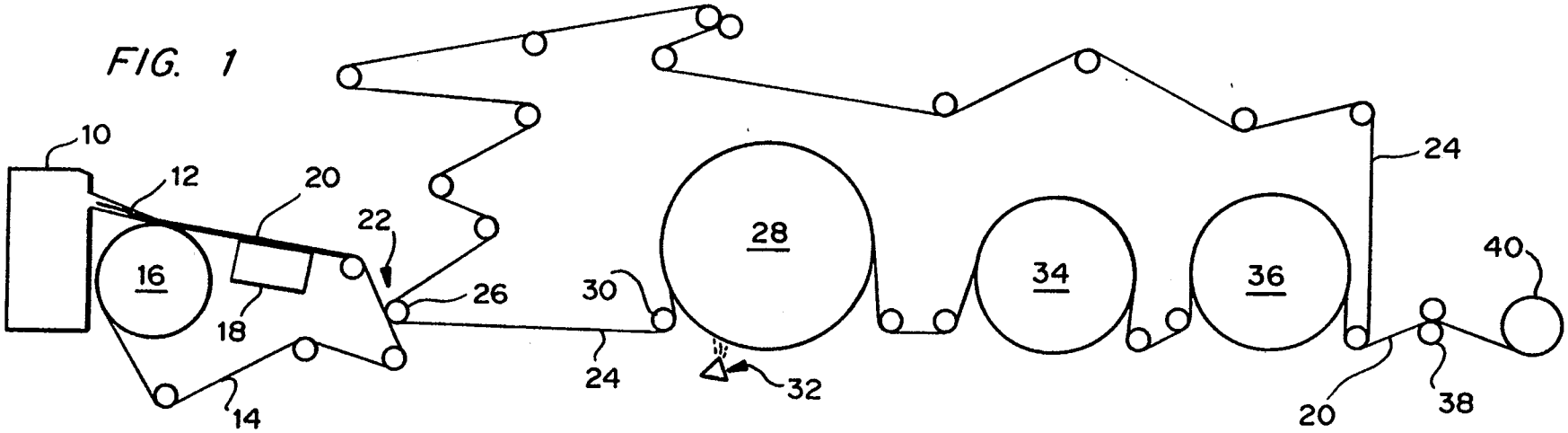
FIG. 1 is a schematic of the papermaking apparatus used to practice the method of the present invention.

Turning first to FIG. 1, there is shown a schematic of the preferred embodiment of the present invention wherein a head box 10 delivers a furnish 12 onto a forming fabric 14 wrapped around a vacuum breast roll 16. The furnish preferably is at a fiber consistency of from about 0.08% to about 0.6% and, more preferably, at a fiber consistency of from about 0.1% to about 0.5%, and most preferably at a fiber consistency of from about 0.1% to about 0.2%. Immediately after the vacuum breast roll 16, forming fabric 14 passes over the vacuum box 18 to further vacuum dewater embryonic web 20.

It should be noted that the type of headbox 10 used is not critical to the practice of the method of the present invention. Any headbox which delivers a well-formed sheet may be employed. Further, although the embodiments discussed herein and depicted in FIGS. 1, 2 and 3 utilize a vacuum breast roll, this too is not critical to the practice of the method of the present invention. The method may be used with breast roll formers, twin wire formers and fourdriniers, as well as variations thereof.

Forming fabric 14 then passes through a transfer zone 22 wherein the web 20 is transferred onto a carrier fabric 24. The transfer is made with the help of a vacuum pickup roll or transfer shoe 26. The transfer of the web from forming fabric 14 to carrier fabric 24 should be made when the web consistency is no greater than 43%. Preferably, consistency of the web 20 in the transfer zone 22 should be in the range of from about 18% to about 35% and most preferably, from about 26% to about 32%.

Transfer of web 20 from forming fabric 14 to carrier fabric 24 can be and is preferably made with a negative draw. By negative draw it is meant that the carrier fabric is moving more slowly than the transfer fabric 14 in the transfer zone 22 and, thus, web 22 is contracted in the machine direction on transfer to effect a web treatment similar to that of wet creping of the sheet. This negative draw transfer can be accomplished, for example, by the methods taught in U.S. Pat. No. 4,440,597 to Wells, et. al. or U.S. Pat. No. 4,072,557 to Schiel. The amount of negative draw can vary substantially, Schiel teaches a method wherein the amount of negative draw is in the range of 3% to 50% meaning that the speed of the carrier fabric 24 would be in the range of from about 97% to about 50% of the speed of the forming fabric 14. However, it should be understood that negative draw is not critical to achieving the benefits of the method of the present invention, including, a lower machine direction variation in web strength and basis weight. Negative draw, in combination with the vacuum pickup, aids in locking the wet web into the topography of the pickup wire 24.

Carrier fabric 24 is an endless belt or wire with knuckles or protuberances projecting therefrom. As such carrier fabric 24 can be a woven fabric, a punched film or sheet, a molded belt, or a fabric as taught in U.S. Pat. No. 4,529,480 to Trokhan.

The web 20 is transferred to the knuckled side of the fabric 24. Fabric 24 is then taken over a can dryer 28 such as a Yankee dryer. A press roll 30 may be used to lightly press the fabric 24 against the Yankee 28 with the web 20 restrained therebetween. The amount of pressing of press roll 30 against Yankee 28 can be in the range of 0–400 psi, but preferably approaches the lower limit of such range (e.g. 0.4 psi to 4.0 psi). In such manner, the knuckles of carrier web 24 are pressed into the web 20 restraining the web 20 against non-registered movement in relation to the carrier fabric 24. In other words, the web 20 is sandwiched between the carrier fabric 24 and the can dryer 28 with the knuckles of the carrier fabric 24 imprinting a pattern of densifications into web 20. Because the carrier fabric 24 includes recessions surrounding each knuckle, preferably only the knuckles press the web 20 against the can dryer 28. A spray 32 may be used to apply a release to the can dryer 28 to ensure that the web 20 leaves the dryer 28 when carrier fabric 24 leaves the surface of the dryer 28. As an alternative to using roll 30 as a press roll, fabric 24 can press the web 20 against the surface of can dryer 28 through wire tension alone. In such case, the amount of pressing would also depend on the radius of can 28. Wire tension should, preferably, be in the range 10 to 40 PLI and, most preferably, be in the range of 16 to 18 PLI. Stated otherwise, the amount of pressure exerted by wire 24 on web 20 and can 28 may be governed by the tension in wire 24 alone. Wire 24 is then brought over after dryer cans 34 and 36 to complete drying of the web. Preferably, upon leaving the second after dryer can 36, the web has reached a dryness of from about 90% to about 97%. The webs may then be calendared at rolls 38 and wound onto a reel 40.

Carrier wire 24 is a continuous or endless wire and thus travels over a series of guide rolls, through a drive roll section and through a tensioning roll section and back to the transfer zone 22. In the transfer zone 22, as discussed previously, the transfer may be accomplished with some amount of negative draw.

As mentioned above, the carrier fabric 24 has a plurality of knuckles or protuberances arranged in a pattern and extending therefrom. Preferably, the maximum spacing between the adjacent knuckles is equal to or less than the length of the longest fiber in the furnish 12. Most preferably, the maximum spacing between adjacent knuckles is equal to or less than the average fiber length in the furnish 12. Thus, since the present invention is directed primarily to making towel and tissue product in a range of basis weight from 7 to 70 pounds per ream, using wood pulp furnishes typical to those types of product, the knuckle spacing between adjacent knuckles should be in the range of 2.5 millimeter or less. The area of the web 20 actually pressed by the knuckles is preferably in the range of 5% to 30% of the area of the web 20.

The carrier wire 24 selected depends on the properties desired in the product and the furnish being used. If higher bulk is desired, one would select a carrier wire 24 with large void spaces. This could be a coarse mesh fabric. Because the vacuum pickup roll or transfer shoe 26 acts to conform the web 20 to carrier wire 24, the larger voids will aid in imparting greater bulk to the web. On the other hand, if more strength were desired one could select a carrier fabric 24 with more knuckles to press the sheet or one could sand the existing knuckles to create a larger press area. It can be envisioned that a limitless combination of geometries in woven fabrics and endless belts can be used to produce a large variety of sheet structures to meet specific product needs.

The negative draw practiced in transfer zone 22, although not critical to obtaining the uniformity benefits of the present invention, is helpful in imparting additional favorable properties to the end product. In particular, the negative draw creates a machine direction stretch in the base sheet as well as a Z-direction fiber orientation and structure. This structure is maintained by the present invention through the maintenance of the web 20 on carrier fabric 24, and in registration therewith during drying to a critical dryness level, and preferably, through completion of the drying of the web 20.

It should be recognized that although the web 20 is pressed against the can dryers 28, 34, and 36, ostensibly through fabric tension, the sheet is not dewatered by pressing. Because the web 20 remains in registration with the carrier fabric 24 through the entire drying, the only pressing of the web 20 is at the knuckled areas of the fabric 24.

As mentioned above, the amount of pressing of the fabric 24 onto the drying cans 28, 34, 36 is relatively light and preferably the result of fabric tension only. This fabric tension has been run at 16 to 18 PLI as measured by a Huyck tensiometer placed one foot before the first drying can. It has been found that the sheet wants to leave the fabric and transfer to the drying surface if the fabric tension is too high. This adhesion to the drying surface could pull the web 20 away from the drying fabric 24 and could then cause misregistration of the web 20 and the fabric 23 if the tension is not properly controlled.

Figure 2:
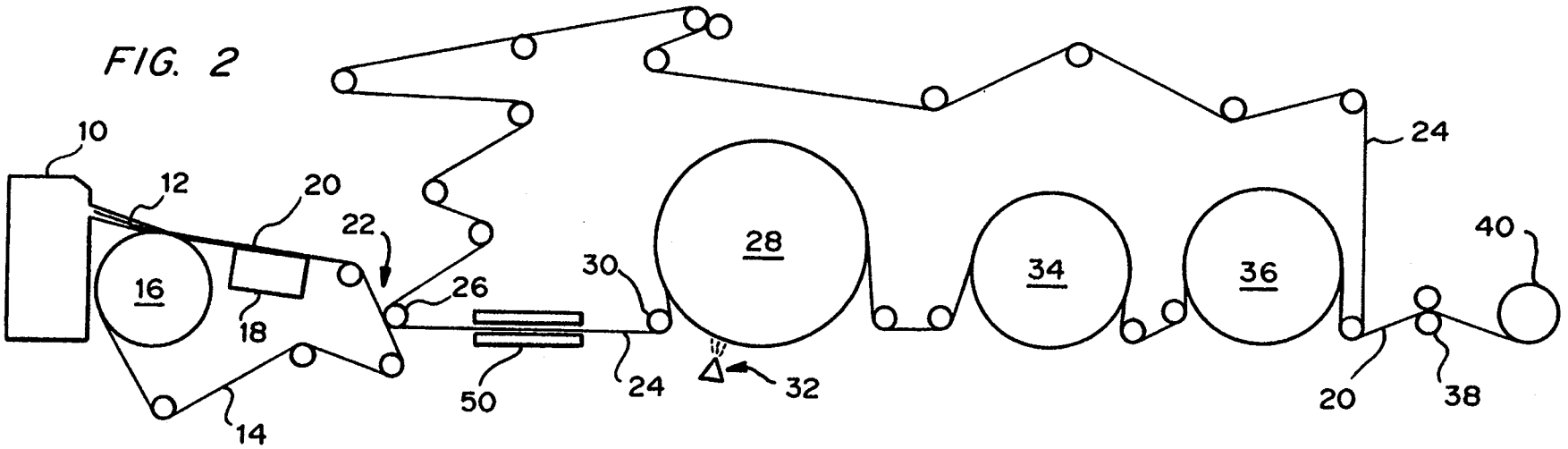
FIG. 2 is a schematic of an alternative embodiment of the present invention.

Looking next at FIG. 2, there is shown a schematic of the front of the embodiment of the present invention which is essentially identical to the embodiment depicted in FIG. 1 with the exception that there is a through drier 50 located between the vacuum pickup roll 26 and the Yankee or can dryer 28. All other components depicted in FIG. 2, being the same as those depicted in FIG. 1, have thus been numbered identically for simplicity.

Figure 3:
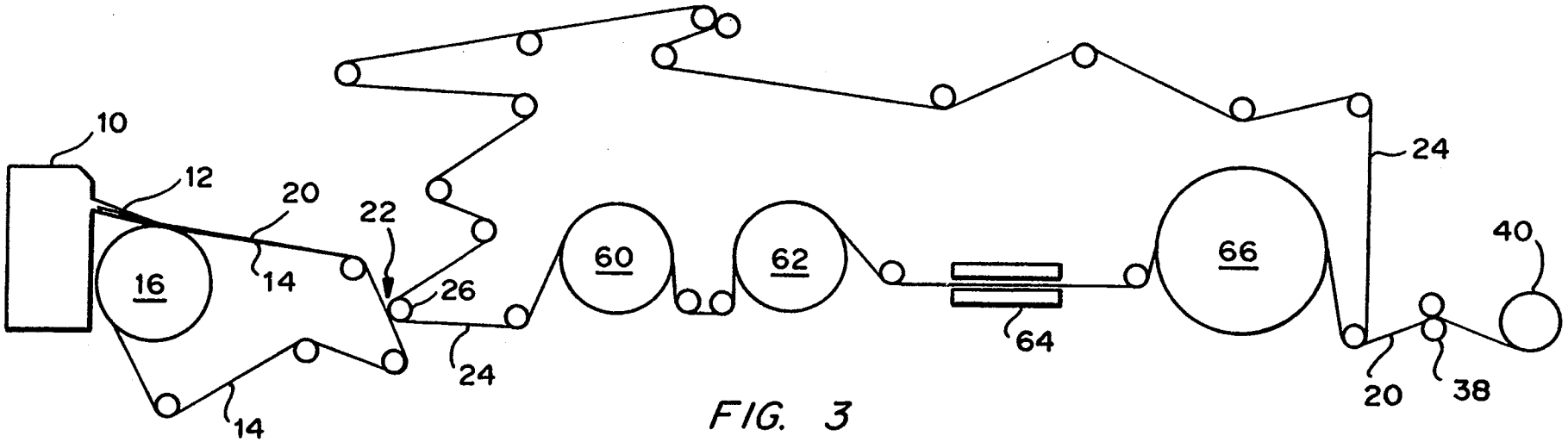
FIG. 3 is yet another schematic of an alternative embodiment of the present invention.

Looking next at FIG. 3, there is shown a schematic of a second alternative embodiment. In this alternative embodiment, head box 10 delivers the furnish 12 onto a forming wire 14 travelling around a suction breast roll 16. The web is transferred by means of a vacuum pickup roll 26 onto a through dryer or pickup wire 24. The web is then taken across two electric after dryers 60, 62. The web 20, still in registration with wire 24 is then taken through a through dryer 64 and then over a Yankee or can dryer 66. As was the case with previous two embodiments, wire 24 runs in a continuous loop, and thus returns back to the pickup roll 26. The web is pulled from wire 24 after it leaves the Yankee 66 and is rolled on reel 40.

The base sheet formed in the process of the present invention has surprising strength for the bulk and density of the base sheet. This makes it highly suitable to make low basis weight towels and tissues without sacrificing quality. Another unexpected feature of this process is the exceptional machine direction uniformity of the base sheet achieved with restrained can drying of the web 20. Specifically, with regard to bulk, the bulk for the typical creped base sheets (e.g. 12–16% crepe) is in the range of 144 to 288 with the bulk increasing as the sheet strength decreases. (The procedure used for measuring bulk is discussed below.) Looking at Table A, there is presented data on a variety of sample base sheets made with four different processes. Where tests were run on more than one sample from each process, the data has been averaged. All of the sheets were made with the same furnish, that being 35% southern Kraft pine wet lap, 35% recycled fiber and 30% CTMP Fiber. The particular CTMP fiber used is described in U.S. Pat. No. 4,849,053 to Gentile, Jr., et. al. Although the four processes are different, the same head box and forming wire were used in each process. Tests 1–13 represent sheets made with the process of the present invention. All drying after the negative draw transfer was done by can drying. Tests 14–27 represent sheets made wherein the sheets were dried via a through dryer. The sheets of test 28 were made with a wet crepe process. The base sheets of tests 29 and 30 were made with a process wherein drying was partially accomplished with a through dryer and then the sheets were transferred to a Yankee dryer and creped therefrom. The carrier fabric used was an Albany 5602 drying fabric (as supplied by Albany International, Appleton Wire Division, Appleton, Wisconsin) and the transfer of the web 20 onto the carrier wire 24 was made with a 10% negative draw. Comparing the data, the base sheets made according to the present invention have a higher bulk than either a base sheet that was through dried and then creped or a wet creped base sheet. (By wet crepe it is meant that the web is creped from the Yankee at a dryness in range of 50%–70%). The bulk for the restrained can dried base sheet (tests 1–13) of the present invention (334 mils average) is higher than either the combination of a through dried and creped base sheet (243 mils) or the wet creped base sheet (186 mils) and the strength is 30–50% greater.

TABLE A

Comparison of Processes utilizing the same furnish and the same forming system.

| PROCESS | TESTS | BULK (MILS) | BW (lb/rm) | GMBL (M) | APPARENT DENSITY (g/cc) | WATER HOLDING CAPACITY g/g (GRAMS OF WATER PER GRAM OF FIBER) |
|---|---|---|---|---|---|---|
| 100% Can Dried, Not Creped | 1–13 | 334 | 24.4 | 1778 | .117 | 4.26 |
| 100% Through Dried, Not Creped | 14–27 | 379 | 24.1 | 1627 | .102 | 4.55 |

TABLE A-continued

Comparison of Processes utilizing the same furnish and the same forming system.

| PROCESS | TESTS | BULK (MILS) | BW (lb/rm) | GMBL (M) | APPARENT DENSITY (g/cc) | WATER HOLDING CAPACITY g/g (GRAMS OF WATER PER GRAM OF FIBER) |
|---|---|---|---|---|---|---|
| Through Dried and Creped | 29–30 | 243 | 22.1 | 1172 | .150 | 3.86 |
| Wet Creped | 28 | 186 | 22.8 | 1349 | .190 | 3.91 |

Furnish 35% Southern Kraft Pine Softwood 35% Recycled Fiber 30% CTMP
GMBL = Geometric Mean Breaking Length
BW = Basis Weight Table A includes a column of data identified as apparent density. Apparent density is defined herein by the following equation.

Apparent Density (grams/cc.) = BW/bulk = {(Basis Weight) (1 sq. m./10000 sq. cm.)* (1.695 gm*rm/(sq. m.*lb.)}/{(Bulk mils/24 sheets) (inch/1000 mils) (2.54 cm/inch) = 1.602 Basis Weight/Bulk Wherein: Ream = 2880 square feet = rm.

Basis Weight = lbs. per 2880 square feet conditioned at 50% relative humidity and 23 degrees Centigrade for 24 hours.

Geometric Mean Breaking Length (meters) = GMBL = 659 $(MDT*CDT)^{\frac{1}{2}}/BW$ The bulk gained due to the process of the present invention does not seem to be dependent upon strength (see Table A). The all through dried base sheet has a higher bulk (average 379) than the restrained, can dried base sheet of the present invention at the same strength levels with the bulk/basis weight ranging from 14.7 to 16.4. Again there seems to be no statistical correlation between bulk and strength. The bulk of the base sheet made with the process of the present invention depends more on the fabric selected than the strength or the basis weight. As an example, a bulk of 301 was produced (26.4 bulk/bw) for a tissue product at a 11.4 pound per ream basis weight using a 100% hardwood pulp furnish and the Albany 5602 fabric By comparison, another furnish (30% CTMP/35% recycled Fiber/35% southern pine) was run using two coarser wires (Asten 803 and Asten 920 as manufactured by Asten Forming Fabrics, Inc of Greenville, S.C. The base sheets made using these two wires are compared with the Albany 5602 in Table B. The coarser Asten 803 fabric with a higher contact area produced about the same bulk as the Albany 5602, while the coarser Asten 920 fabric with the same contact area produced a higher bulk.

TABLE B

| FABRIC | KNUCKLES PER SQ. IN. | CONTACT AREA | BULK (MILS) | GMBL (METERS) | DENSITY (G/CC) | BULK/BW | MESH |
|---|---|---|---|---|---|---|---|
| ASTEN 803 LSK SIDE | | | | | | | |
| D1 | 384 | 14.7% | 325 | 1923 | .318 | 15.0 | 28 × 25 |
| E1 | | | 368 | 1723 | .318 | 16.4 | |
| ASTEN 920 LSK* SIDE 5 SHED BROKEN TWILL | | | | | | | |
| D | 210 | 10.0% | 402 | 2001 | .337 | 17.9 | 23 × 20 |
| E | | | 447 | 1819 | .328 | 19.7 | |
| ALBANY 5602 LSK SIDE 4 SHED BROKEN TWILL | | | | | | | |
| AVERAGE | | 10.0% | 334 | 1778 | .349 | 13.7 | 36 × 29 |

(*LSK means long shute knuckle)

Bulk can also be changed in the base sheet in other ways. Specifically, lower negative draw produces lower bulk with higher strength. In addition, pressing of the imprinting fabric 24 against the drying can 28 using a press roll can be used to reduce bulk. In one test, using a pressing roll, the bulk was reduced 15% with a 6% increase in strength using the Albany 5602 carrier fabric and a 15% negative draw. A sheet made with the process of the present invention has a strength benefit over a completely through dried sheet. Tests have shown that a completely can dried base sheet made in accordance with the process of the present invention is 19% to 40% stronger than a completely through dried base sheet, the furnishes being substantially identical. Of particular note, tests on the variability of the web rolls produced with the process of the present invention indicate a significant improvement over the variability obtained using the processes of the prior art, including a 100% through dried sheet. There are two types of variability reduction that result from the process of the present invention. Can drying in accordance with the present invention and 100% through drying both produce a base sheet having less long term variability than creped sheets. In otherwords, roll to roll and day to day, the base sheet is consistent. The second type of variability that can be reduced by the present invention is short term variability, that is, the variability within one roll. To obtain this short term variability reduction, it has been found that the sheet must be can dried from no more than 40% dry to at least 60% dry. Although it is preferable to complete the drying from the point where the sheet has been vacuum dewatered to about 97% dry on cans, drying after 60% dryness has been reached can be accomplished through other means such as through dryers, with the variability improvement of the present invention still being attained.

It is theorized that the mode of drying, in particular, can drying, combined with the restriction of movement of the sheet, and the selective pressing of the sheet by the carrier fabric are key components of the process to produce a uniform sheet. Drying cans evaporate water in the wetter area of the base sheet more rapidly than the dryer areas thus reducing moisture variation in the sheet. On the other hand, through dryers pass more air through the dryer areas of the sheet than the wetter areas of the sheet, thereby amplifying any moisture variations which exist in the sheet as it is dried. With can drying, it is believed that the more uniform moisture in the sheet produces more uniform drying stresses in the sheet which, in turn, help produce a more uniform base sheet. The sheet, held or restrained between the knuckles of the fabric and the drying can surface, further controls shrinkage which should also help to make a more uniform sheet.

Figure 4:
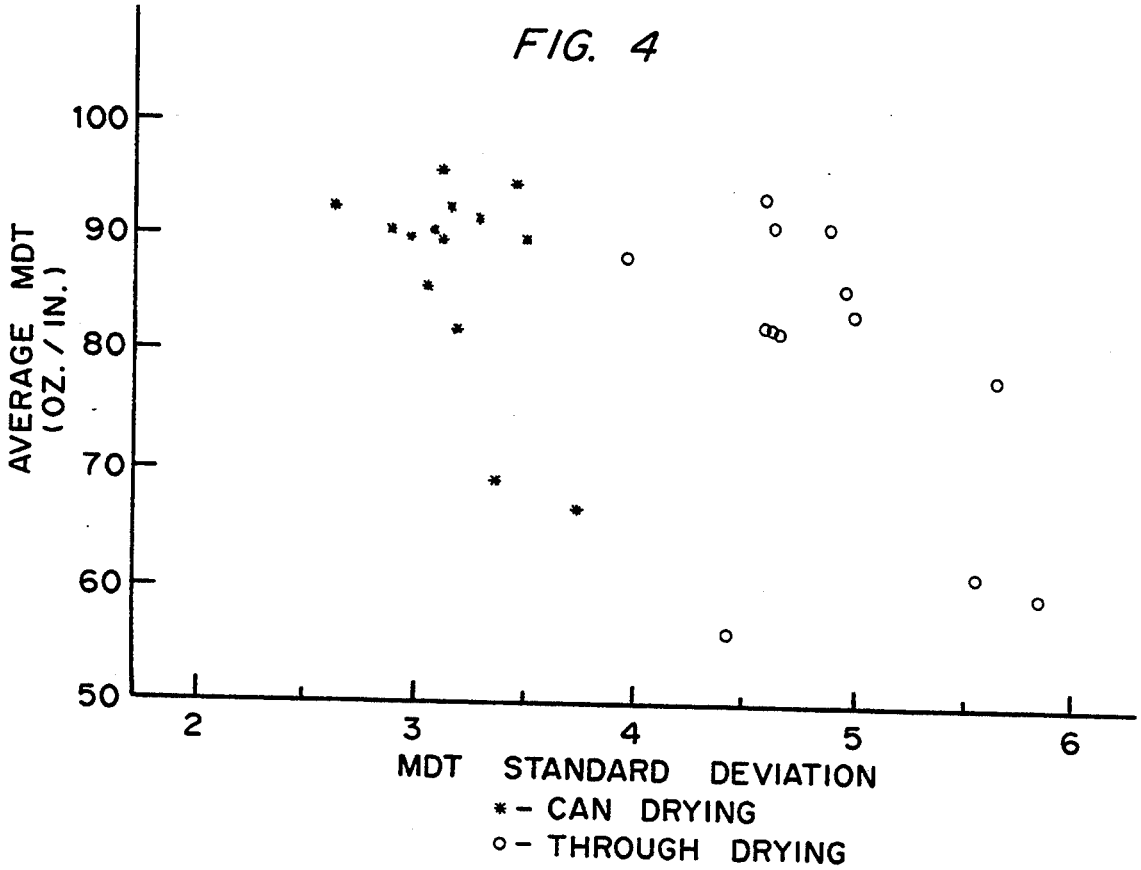
FIG. 4 is a graph plotting average machine direction tensile strength (in ounces/inch) versus machine direction tensile strength variability (in standard deviations) for sample base sheets made with 100% restrained can drying and 100% through drying.
Figure 5:
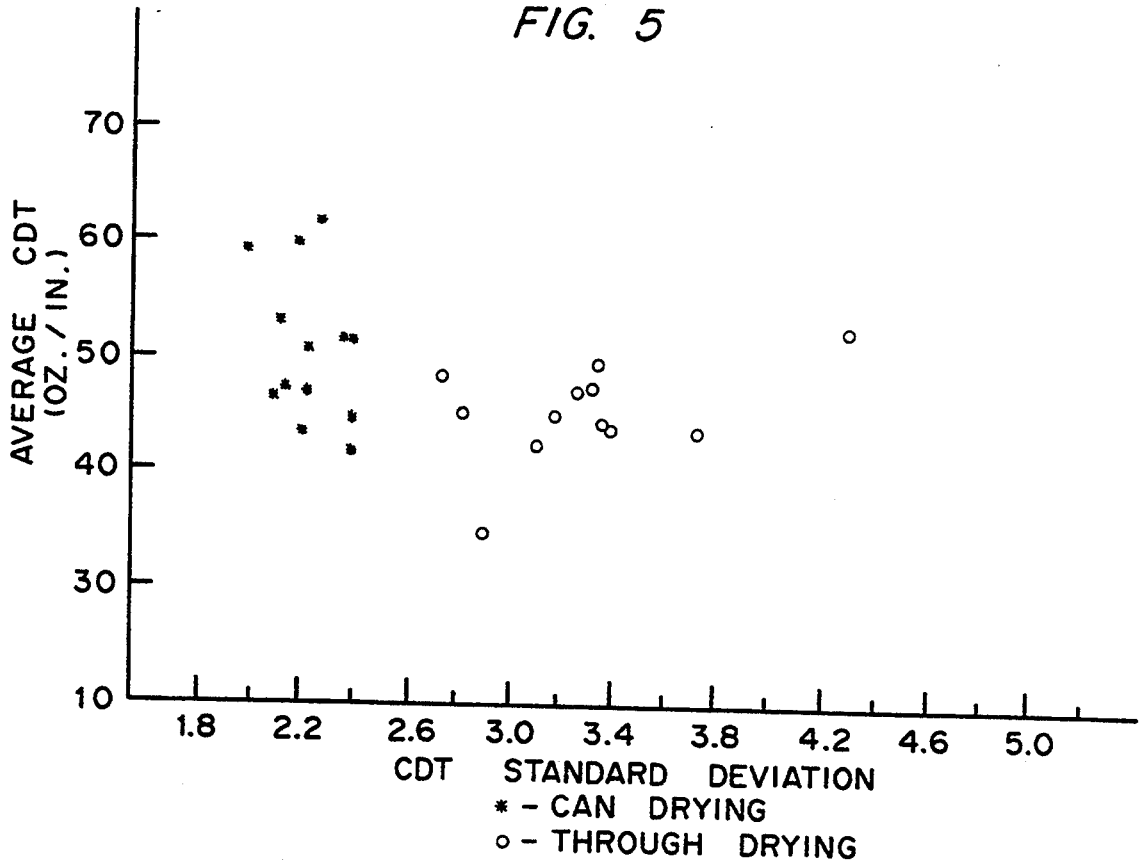
FIG. 5 is a graph plotting average cross direction tensile strength (in ounces/inch) versus cross direction tensile variability (in standard deviations) for sample base sheets made with 100% restrained can drying and 100% through drying.

FIG. 4 sets forth a comparison graph of machine direction tensile (MDT) versus variability (in standard deviations of the MDT), of a 100% restrained, can dried base sheet with a 100% through dried base sheet. Both samples were made with a 10% negative draw and were made with the same furnish (35% southern Kraft pine wet lap refined to 500 Canadian Standard Freeness (CSF), 35% recycled fiber, 30% Miller-Western Softwood CTMP, 1.5% wet strength resin, 0.2% dry strength resin). The head box consistency was between 0.14 and 0.15%. As can be seen in FIG. 4 (and Table C), the variability (within a roll) as defined by the standard deviation of the MDT is consistently lower for the 100% restrained, can dried sheet than for the through dried sheet. It can also be seen that the standard deviations tend to be higher for samples with lower MDTs. The difference in variability between the two drying methods is unexpected since both restrain the sheet on a wire. Variability in the cross direction tensile (CDT) is also reduced for a 100% can dried sheet versus a 100% through dried sheet. This can be seen in FIG. 5. The data from the test runs used to generate FIG. 4 is tabularized in Table C.

TABLE C

| | CAN DRIED FROM 30% TO 95% DRT | THROUGH DRIED FROM 30% TO 95% DRY |
|---|---|---|
| Range of MDT Average MDT (oz/in.) | 63 to 96 | 57 to 94 |
| Number of Runs | 14 | 13 |
| Standard Deviation of MDT (ox/in.) | 2.7 to 3.7 | 4.1 to 5.8 |

Trials were also conducted where the base sheet was partially can dried and then through dried to complete the drying process. It was found that the variability was consistent with that of a 100% restrained can dried sheet as long as the sheet is restrained, can dried from no more than about 40% dry to at least 60% dry, before through drying. The data from these trials is set forth in Table D showing the short form variability of a non-creped base sheet as determined by the standard deviation of the MDT throughout the test roll. When the sheet was restrained, can dried to a dryness of less than 60%, the variability was greater and more consistent with that of a 100% through dried sheet.

Tests were also conducted wherein the sheet was first through dried and then restrained, can dried. The variation in the machine direction tensile was the same as 100% restrained can drying as long as the dryness achieved with through drying was no more than 47%. When the sheet was through dried to 60% to 72% before restrained, can drying, the variation increased to the point that it was within the range of a 100% through dried sheet. These observations indicate that the critical range where the sheet must be restrained can dried to produce the lowest variability is between 47% and 60% sheet dryness. The short term viability data from these tests is set forth in Table E.

TABLE D

| | CAN DRIED TO A DRYNESS LESS THAN 60% | CAN DRIED TO A DRYNESS GREATER THAN 60% |
|---|---|---|
| Average MDT (oz/in.) | 75 to 88 | 82 to 93 |
| Numbers of Tests | 6 | 3 |
| Standard Deviation of MDT (oz.in.) | 3.8 to 4.2 | 3.0 to 3.3 |

TABLE E

| | THROUGH DRIED TO A DRYNESS LESS THAN 47% | THROUGH DRIED TO A DRYNESS GREATER THAN 59% |
|---|---|---|
| Range of MDT (oz/in.) | 83 to 93 | 75 to 80 |
| Numbers of Tests | 3 | 3 |
| Standard Deviation of MDT (oz.in.) | 3.3 to 3.7 | 4.7 to 4.8 |

Although it is preferable to practice the present invention using negative draw in the transfer zone 22, the amount of negative draw does not improve the variability of the base sheet obtained with the process of the present invention. Table F presents data wherein the amount of negative draw (1% to 15%) was varied using the restrained, can drying process of the present invention. From this data, it can be seen that negative draw does not change the variability of the base sheet, and therefore, is not a necessity in practicing the process of the present invention to achieve the improved uniformity that comes with restrained, can drying. Test data indicates that the same is not true for 100% through dried web. See Table G below.

TABLE F

| COEFFICIENT OF VARIATION X 100% | | | | | |
|---|---|---|---|---|---|
| | PERCENT NEGATIVE DRAW | | | | |
| PROPERTY | 1% | 4% | 10% | 10% | 15% |
| Machine Direction Tensile (MDT) | 2.6% | 3.3% | 3.4% | 3.6% | 3.6% |
| Cross Direction Tensile (CDT) | 5.3% | 4.3% | 3.7% | 4.7% | 3.9% |
| Basis Weight (BW) | 1.13% | .63% | .65% | .74% | .35% |

TABLE G

| VARIABILITY OF A 100% THROUGH DRIED BASE SHEET VACUUM DEWATERED | | | |
|---|---|---|---|
| NEGATIVE DRAW % | MDT MEAN (OZ/IN.) | STANDARD DEVIATION (OZ/IN.) | CONDITIONED BW |
| 2.5 | 72.1 | 11.02 | 19.8 |
| 5.0 | 62.2 | 7.96 | 19.7 |
| 8.0 | 51.4 | 5.65 | 19.4 |

Figure 6:
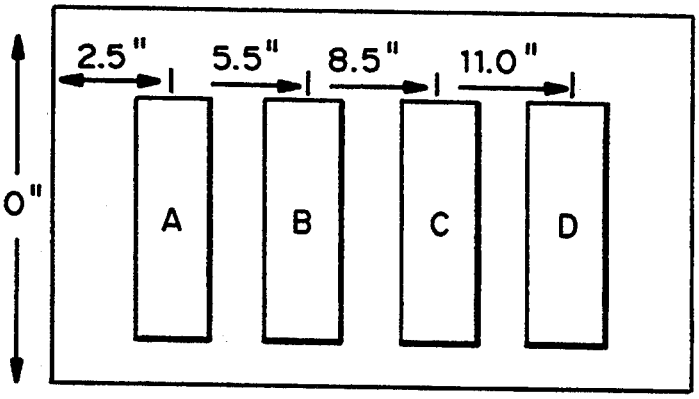
FIG. 6 depicts the sampling pattern used to gather samples for the machine direction tensile strength data presented herein.

Furnish
15% Southern Kraft Softwood refined to 500 CSF
20% CTMP
65% Recycled Fiber
.5% Dry Strength Resin
.5% Wet Strength Resin Sampling of rolls for the data presented in the tables herein was conducted in the following manner. For MDT data, a roll of base sheet was slabbed to produce eight (8) samples approximately 400 ft. apart. Four MDT sample strips were cut from each sample as shown in FIG. 6. The MDT (and CDT) was tested at a 2 inch span at 2 in./min. This gave 4 MDT tests for each of the 8 samples or 32 total MDT tests for each roll. The average MDT and its standard deviation was calculated for each roll from the 32 tests.

Figure 7:
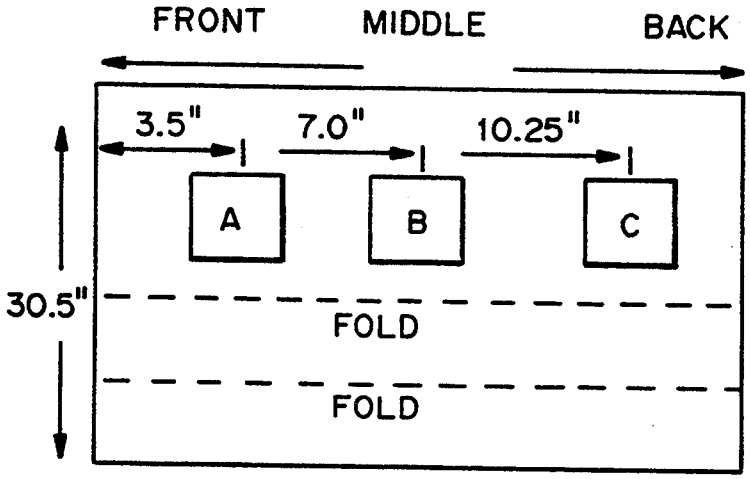
FIG. 7 depicts the sampling pattern used to gather samples for the basis weight data presented herein.

For basis weight data, a 30.5 inch long piece from each sample was folded four times to give eight plies. Three 2.45" by 2.45", eight ply basis weight squares were cut from each folded sample as shown in FIG. 7. The samples were weighed to determine the basis weight. This gave three tests for each of 8 samples, or 24 total tests for each roll. The average basis weight and the standard deviation for each roll were calculated from the 24 tests.

Figure 8:
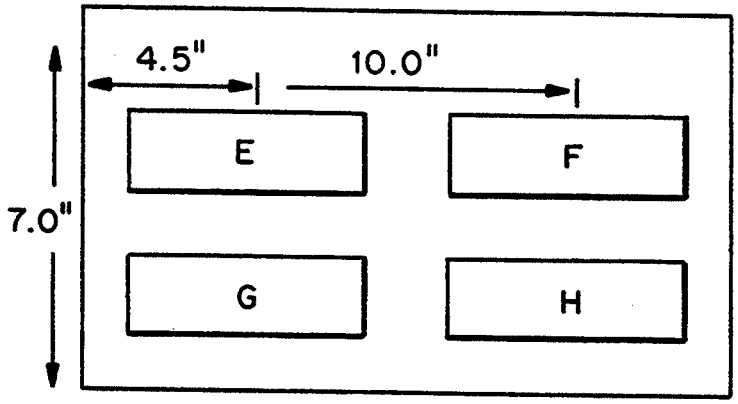
FIG. 8 depicts the sampling pattern used to gather samples for the cross machine direction tensile strength data presented herein.

For CDT data, a duplicate CDT strip at each of two positions was cut from each sample as shown in FIG. 8. This gave four CDT pulls for each of the samples or 32 CDT pulls for the entire roll. The average CDT and its standard deviation were calculated for each roll.

In each case, the average or mean was calculated with the following formula:

$$\text{Mean} = \frac{\sum_{i=1}^{n} X_i}{n}$$

Wherein: $X_i$ = Individual test $n$ = number of samples

The standard deviation was, in each case, calculated using the formula:

$$\text{Sample standard deviation} = \left( \frac{\sum_{i=1}^{n} (X_i - X)^2}{n-1} \right)^{\frac{1}{2}}$$

Wherein: $X_i$ = Individual test $n$ = number of samples

Another important result of the can drying process wherein drying is conducted with the web being lightly pressed against the drying can with the knuckled fabric, is the mechanics of what occurs within the sheet during drying. The ratio of the Cured Cross Direction Wet Tensile to the Cross Direction Tensile (CCDWT/CDT), and the wet tensile have been found to be about 15% higher for the can dried base sheet of the present invention compared to a through dried base sheet. See Table H. As will be discussed hereinafter, the increase in CCDWT is felt to be the result of the wet strength resin additive (e.g., polyaminoamide epichlorohydrin) in the furnish migrating to the knuckle points with the fines as the sheet dries.

TABLE H

| | 100% THROUGH DRIED | | | 100% RESTRAINED CAN DRIED | |
|---|---|---|---|---|---|
| CDT OZ/IN | CCDWT OZ/IN | WET/DRY % | CDT OZ/IN | CCDWT OZ/IN | WET/DRY % |
| 48 | 15.7 | 32.7 | 48.0 | 16.8 | 35.0 |
| 49.7 | 16.0 | 32.1 | 45.0 | 16.3 | 36.2 |
| 46.3 | 16.0 | 34.5 | 44.0 | 18.8 | 42.7 |
| 45.2 | 16.4 | 36.2 | 49.6 | 18.2 | 36.7 |
| 59.0 | 18.1 | 30.6 | 50.2 | 18.5 | 36.8 |
| 43.6 | 14.1 | 32.3 | 41.0 | 15.0 | 36.6 |
| 35.7 | 11.0 | 30.8 | 43.2 | 15.9 | 36.8 |
| 54.8 | 16.4 | 30.0 | 51.5 | 18.3 | 35.5 |
| 40.3 | 13.2 | 32.7 | 50.2 | 17.1 | 34.1 |
| 44.3 | 13.4 | 30.2 | | | |
| 43.1 | 12.6 | 29.2 | | | |
| AVERAGE | | | | | |
| S.D.* | | | | | |
| 46.3 | 14.8 | 31.9 | 46.9 | 17.2 | 36.7 |
| 6.5 | 2.1 | 2.1 | 3.7 | 1.3 | 2.4 |

(*S.D. = Standard Deviation)

With the present invention, tests were conducted using a non-substantive dye in the furnish. When the sheet was completely restrained, can dried, dye intensity was greatest where the knuckles of the carrier fabric pressed the sheet against the drying can. This indicates that the largest percentage of water flows to the knuckles where it evaporates. The water is believed to flow to the knuckles by either of two mechanisms. The first would be due to the capillary forces which draw water to the knuckles since the web in the knuckled areas has a higher density (finer pores). The second would be the flow of water from the area of the high concentration (loft areas) to areas of lower concentration (knuckles areas). These two phenomena cause the water to flow from the low density, non-pressed areas of the sheet to the higher density, pressed areas of the sheet, where it evaporates. The flow of water to the knuckle areas may aid in the formation of the densifications in the web.

When the sheet was completely through dried, the dye was uniformly distributed in the sheet. This indicated that the water was evaporating from the entire area of the sheet rather than in preferential areas. In conducting such tests, it was found that the wet strength resin (e.g., Kymene 1200 manufactured by Hercules, Inc.) helped to attach or affix the dye onto the fibers and thus retarded its movement. Later tests were conducted without the addition of wet or dry strength resins in the furnish to monitor the movement of the water and dye. In one of such tests, a sheet was first partially through dried and then restrained, can dried. It was observed that concentrations of the dye in the knuckle areas where the fabric pressed the sheet against the cans was achieved as long as the sheet dryness leaving the through dryer was 36% or less. The intensity of dye at the knuckles diminished substantially when the dryness leaving the through dryer increased to 43% and was almost completely gone at 52% dry.

Looking at the opposite side of the sheet (the side of the web away from the surface of the can dryer), it was observed that the intensity of the dye on this side increased as the dryness leaving the through dryer increased. This side of the sheet was almost white at 36% dry leaving the through dryer increasing in color as the dryness leaving the through dryer increased. This further indicates that less water was migrating to the knuckle areas of the sheet as the sheet leaving the through dryer became dryer.

Tests were also conducted wherein the base web was first restrained, can dried with drying being completed with the through dryer. The dye was visible in a knuckle pattern when can drying only to a level of 34%. The higher the dryness leaving the can dryers, the darker the knuckle areas became and the whiter the loft areas became. At 55% dryness leaving the can dryers, there seem to be almost no dye in the loft areas.

As noted earlier, the can dried sheet has a higher CCDWT than the through dried base sheet using the same furnish. The CDT was also higher. Table I shows the percent wet/dry (CCDWT/CDT) of a sheet wherein the initial stages of drying were conducted with restrained, can drying and finally with through drying. Table I shows correlation between the percent wet/dry and the dryness of the web leaving the can before the web is through dried to a dryness of 95%. It can be seen that the sheet must be can dried to at least 50% to develop the maximum wet/dry.

TABLE I

EFFECT OF DRYNESS LEAVING CANS ON WET/DRY

| DRYNESS OF SHEET ENTERING THROUGH DRYER % | CDT OZ/IN | CCDWT OZ/IN | WET/DRY (CCDWT/CDT)*100% % |
|---|---|---|---|
| 30[1] | 46.3 | 14.8 | 31.9 |
| 39 | 45.0 | 14.9 | 33.1 |
| 44.5 | 52.1 | 18.4 | 35.4 |
| 52 | 52.3 | 19.2 | 36.7 |
| 61 | 48.5 | 18.1 | 37.3 |
| 64 | 51.6 | 19.3 | 37.4 |
| 77 | 46.0 | 17.4 | 37.8 |
| 95 | 46.9 | 17.2 | 36.7 |

([1]No can drying)

From the foregoing, it is concluded that the chemicals (wet strength resins) must have migrated to the knuckle area of the sheet during can drying. This was confirmed by conducting iodine vapor adsorption tests on restrained can dried and through dried samples. These tests indicated that the cationic chemical (Kymene 1200) was concentrated at the knuckled areas of the restrained, can dried sheet. Experience has shown that iodine concentrates by adsorption where there is the highest electron density. The electron density of the Kymene molecule indicates that the iodine was probably adsorbing on the Kymene . Therefore, it is believed that Kymene was concentrated in the knuckle areas. This is substantiated by the fact that the wet strength of the restrained, can dried base sheets are higher than that of the through dried base sheets. The migration of the Kymene during restrained, can drying results in something akin to dot print bonding of the sheet thereby improving the wet strength.

Chemical additives can concentrate at the knuckled areas in two ways. Any chemical additives not tightly bound to the paper fibers can migrate to the knuckle areas as the free water flows to the knuckles were it evaporates. Further, in that it is known that fines will flow in a sheet as the water flows, the fines concentrate in the finer pores where the knuckles press the sheet. Because it is known that fines absorb larger amounts of chemicals relative to other paper fibers because of their much larger surface area, the concentration of fines in a knuckled area would also yield a higher concentration of chemical additives in the knuckled areas or densifications.

The mechanics of the migration of Kymene (which is cationic) to the knuckled areas of the web through the practice of the process of the present invention should be practicable with other chemicals added to the furnish. Particularly, any non-ionic or anionic chemical additives or dyes should migrate to the surface of the web where the web contacts the drying cans. Further, such chemical additives and dyes should concentrate in the areas where the knuckles press the sheet against the drying cans. Examples of chemical additives and dyes found to concentrate in the densifications or knuckled areas include the nonionic dye Turquoise Cibacrone GR (manufactured by Ciba Geigy), FD&C Blue #1 (an anionic dye made by Warner Jenkins), Carta Blue 2GL (an anionic dye made by Sandoz Chemical Co.), and Acco 85 (an anionic dry strength regin produced by Cyanimid.

From the foregoing, it will be seen that this invention is one well adapted to attain all of the ends and objects hereinabove set forth together with other advantages which are apparent and which are inherent to the process.

It will be understood that certain features and subcombinations are of utility and may be employed with references to other features and subcombinations. This is contemplated by and is within the scope of the claims.

As many possible embodiments may be made of the invention without departing from the scope thereof, it is to be understood that all matter herein set forth were shown in the accompanying drawings as to be interpreted as illustrative and not in a limiting sense.

What is claimed:

1. A process for making a strong, bulky, absorbent paper sheet having a basis weight between about 7 to about 70 pounds per ream comprising the steps of:

(a) forming a web on a forming fabric with a furnish;

(b) dewatering the web non-compressively such that the web is at least 8% dry;

(c) transferring the web from the forming fabric to an imprinting fabric by means of a vacuum pick-up;

(d) forming a pattern of densifications in the web;

(e) can drying the web on the surface of at least one can dryer to at least 60% dry such that only one side of the web is placed in contact against the surface of the can dryer during said can drying step;

(f) restraining the web between the imprinting fabric and the surface of at least one car dryer during said can drying step until the web is at least 60% dry; and (g) maintaining the web in registration with the imprinting fabric during steps d, e, and f such that only a single pattern of densifications is formed in the web.

2. A process for making a strong, bulky, absorbent paper sheet having a basis weight between about 7 and about 70 pounds per ream as recited in claim 1 further comprising the step of:

removing the web from the drying can while the web is still retained on the imprinting fabric.

3. A process for making a strong, bulky, absorbent paper sheet having a basis weight between about 7 and about 70 pounds per ream as recited in claim 2 further comprising the step of:

separating the web from the imprinting fabric when the web is at least 90% dry.

4. A process for making a strong, bulky, absorbent paper sheet having a basis weight between about 7 and about 70 pounds per ream as recited in claim 1 wherein:

said transferring step is performed with the forming fabric travelling at a faster velocity than the imprinting fabric.

5. A process for making a strong, bulky, absorbent paper sheet having a basis weight between about 7 and about 70 pounds per ream as recited in claim 1 wherein:

the vacuum pick-up pulls a vacuum during said transferring step sufficient to conform the web to the topography of the imprinting fabric.

6. A process for making a strong, bulky, absorbent paper sheet having a basis weight between about 7 and about 70 pounds per ream as recited in claim 1 further comprising the step of:

adding to the furnish at least one chemical selected from the group consisting of:

(a) a wet strength resin;

(b) a dry strength resin;

(c) a surfactant;

(d) a debonder;

(e) a dye.

7. A process for making a strong, bulky, absorbent paper sheet having a basis weight between about 7 and about 70 pounds per ream as recited in claim 6 wherein:

the majority of said selected chemical added to the furnish during said adding step migrates to the surface of the individual densifications in the web facing the drying can during said can drying step.

8. A process for making a strong, bulky, absorbent paper sheet having a basis weight between about 7 and about 70 pounds per ream as recited in claim 6 wherein:

the majority of said selected chemical added to the furnish during said adding step migrates to reside in the densifications in the web proximate to the surface of the web facing the drying can during said can drying step.

9. A process for making a strong, bulky, absorbent paper sheet having a basis weight between about 7 and about 70 pounds per ream as recited in claim 1 wherein:

the web is dewatered such that the web is in the range of from about 26% dry to about 32% dry after said dewatering step.

10. A process for making a strong, bulky, absorbent paper sheet having a basis weight between about 7 and about 70 pounds per ream as recited in claim 1, wherein:

the web is dried to at least 90% dry during said can drying step.

11. A process for making a strong, bulky, absorbent paper sheet having a basis weight between about 7 and about 70 pounds per ream as recited in claim 1 further comprising the step of:

separating the web from the drying can without creping.

12. A process for making a strong, bulky, absorbent paper sheet having a basis weight between about 7 and about 70 pounds per ream as recited in claim 1 wherein:

the imprinting fabric includes a pattern of knuckles projecting therefrom, the individual knuckles being spaced apart from one another by a distance not greater than the average fiber length of the furnish.

13. A process for making a strong, bulky, absorbent paper sheet having a basis weight between about 7 and about 70 pounds per ream as recited in claim 1 further comprising the step of:

applying a release to the drying can so that the sheet is not pulled from the imprinting fabric as the web traverses the drying can and as the imprinting fabric exits the drying can.

14. A process for making a strong, bulky, absorbent paper sheet having a basis weight between about 7 and about 70 pounds per ream as recited in claim 1 wherein:

said furnish has a consistency in the range of from about 0.08% to about 0.6% solids at the start of said forming step.

15. A process for making a strong, bulky, absorbent paper sheet having a basis weight between about 7 and about 70 pounds per ream as recited in claim 1 wherein:

said pattern of densifications is formed in the web by lightly pressing the web and the imprinting fabric against a drying can.

16. A process for making a strong, bulky, absorbent paper sheet having a basis weight between about 7 and about 70 pounds per ream as recited in claim 1 wherein:

said can drying step is begun when the web is no more than about 30% dry.

17. A process for making a strong, bulky, absorbent paper sheet having a basis weight between about 7 and about 70 pounds per ream as recited in claim 1 wherein:

said can drying step is begun when the web is no more than about 35% dry.

18. A process for making a strong, bulky, absorbent paper sheet having a basis weight between about 7 and about 70 pounds per ream as recited in claim 1 wherein:

said can drying step is begun when the web is no more than about 40% dry.

19. A process for making a strong, bulky, absorbent paper sheet having a basis weight between about 7 and about 70 pounds per ream as recited in claim 1 wherein:

the imprinting fabric includes a pattern of knuckles projecting therefrom, the individual knuckles being spaced apart from one another by a distance not greater than the average fiber length of the longest fibers in the furnish.

20. A process for making a strong, bulky, absorbent paper sheet having a basis weight between about 7 and about 70 pounds per ream as recited in claim 1 wherein:

said forming the web step is performed with a furnish having a consistency in the range of 0.1% to 0.5% solids.

21. A process for making a strong, bulky, absorbent paper sheet having a basis weight between about 7 and about 70 pounds per ream as recited in claim 1 wherein:

said forming the web step is performed with a furnish having a consistency in the range of 0.1% to 0.2% solids.

22. A process for making a strong, bulky, absorbent paper sheet having a basis weight between about 7 and about 70 pounds per ream as recited in claim 1, wherein:

said furnish includes fibers and fines, the majority of said fines migrating to the densifications during said can drying step.

23. A process for making a strong, bulky, absorbent paper sheet having a basis weight between about 7 and about 70 pounds per ream comprising the steps of:

(a) forming a web on a forming fabric with a furnish having a consistency in the range of from about 0.08% to about 0.06% solids;

(b) dewatering the web non-compressively such that the web is in the range of from about 8% to about 34% dry;

(c) transferring the web from the forming fabric to an imprinting fabric by means of a vacuum pick-up;

(d) lightly pressing the web and the imprinting fabric against a drying can to form a pattern of densifications in the web;

(e) can drying the web on the surface of at least one can dryer from no more than 34% dry to at least 55% dry such that only a single side of the web is ever placed in contact against the surface of the can dryer;

(f) restraining the web between the imprinting fabric and the surface of at least one can dryer during said can drying step until the web is at least 55% dry; and (g) maintaining the web in registration with the imprinting fabric during steps d, e, and f such that only a single pattern of densifications is formed in the web.

24. A process for making a strong, bulky, absorbent paper sheet having a basis weight between about 7 and about 70 pounds per ream as recited in claim 23, wherein:

said furnish includes fibers and fines, the majority of said fines migrating to the densifications during said can drying step.

* * * * *